US010047490B2

(12) United States Patent
Steinlechner

(10) Patent No.: US 10,047,490 B2
(45) Date of Patent: Aug. 14, 2018

(54) DRIVE POINT FOR A PILE

(71) Applicant: Tiroler Rohre GmbH, Hall in Tirol (AT)

(72) Inventor: Erich Steinlechner, Wattens (AT)

(73) Assignee: TIROLER ROHRE GMBH, Hall in Tirol (AT)

( * ) Notice: Subject to any disclaimer, the term of this patent is extended or adjusted under 35 U.S.C. 154(b) by 0 days.

(21) Appl. No.: 15/195,072

(22) Filed: Jun. 28, 2016

(65) Prior Publication Data

US 2017/0370066 A1 Dec. 28, 2017

(51) Int. Cl.

| | |
|---|---|
| ***E02D 5/72*** | (2006.01) |
| ***E02D 5/62*** | (2006.01) |
| ***E21B 10/38*** | (2006.01) |
| ***E02D 5/38*** | (2006.01) |
| *E02D 5/28* | (2006.01) |

(52) U.S. Cl.

CPC ..... *E02D 5/38* (2013.01); *E02D 5/72* (2013.01); *E02D 5/285* (2013.01)

(58) Field of Classification Search

CPC .. E02D 5/285; E02D 5/38; E02D 5/56; E02D 5/72; E02D 7/22

USPC .... 405/231, 233, 236, 242, 248, 252.1, 253, 405/254, 255; 175/19, 21, 22; 52/157, 52/165

See application file for complete search history.

(56) References Cited

U.S. PATENT DOCUMENTS

| | | | | | |
|---|---|---|---|---|---|
| 225,061 | A * | 3/1880 | Johnson | E02D 7/24 | 175/398 |
| 228,467 | A * | 6/1880 | Macklay | E02D 5/72 | 405/254 |
| 1,954,070 | A * | 4/1934 | Cook | E02D 5/523 | 173/131 |
| 1,969,251 | A * | 8/1934 | Bald | E02D 5/72 | 175/23 |
| 2,864,241 | A * | 12/1958 | Fiore | E02D 5/72 | 405/254 |
| 3,194,022 | A * | 7/1965 | Dougherty | E02D 5/72 | 175/19 |
| 3,333,427 | A * | 8/1967 | Dougherty | E02D 5/72 | 175/19 |
| 6,568,881 | B2 * | 5/2003 | Long | E02D 7/24 | 175/21 |
| 2006/0263557 | A1 * | 11/2006 | Watson | B29C 63/18 | 428/36.91 |

(Continued)

FOREIGN PATENT DOCUMENTS

| | | | | |
|---|---|---|---|---|
| EP | 2148011 | A1 * | 1/2010 | E02D 5/24 |
| FR | 391853 | A * | 11/1908 | E02D 5/32 |

*Primary Examiner* — Frederick L Lagman
*Assistant Examiner* — Stacy N Lawson
(74) *Attorney, Agent, or Firm* — Wenderoth, Lind & Ponack, L.L.P.

(57) ABSTRACT

A drive point for a substantially tubular driven pile, wherein the drive point can be fitted onto a pile end of the driven pile, wherein at least one first support limb with a first support surface configured to abut an end face of the pile end of the driven pile is arranged at an inside wall of the drive point, wherein at least one support device with a ground surface is arranged at an outer surface of the drive point, and wherein the ground surface of the at least one support device supports the drive point when on a ground into which the drive point is to be driven in a driving-in direction.

22 Claims, 7 Drawing Sheets

(56) References Cited

U.S. PATENT DOCUMENTS

| | | | | |
|---|---|---|---|---|
| 2012/0195691 | A1* | 8/2012 | Dolly | E02D 5/72<br>405/232 |
| 2015/0023739 | A1* | 1/2015 | Coulon | E02D 5/72<br>405/233 |

* cited by examiner

DRIVE POINT FOR A PILE

BACKGROUND OF THE INVENTION

1. Field of the Invention

The invention concerns a drive point for a substantially tubular driven pile, wherein the drive point can be fitted onto a pile end of the driven pile, wherein at least one first support limb with a first support surface configured to abut an end face of the pile end of the driven pile is arranged at an inside wall of the drive point.

2. Description of Related Art

Drive points of that kind are used in the construction industry for making pile foundations. The individual driven piles which generally comprise ductile cast iron and are of predetermined lengths of, for example, five meters are fitted one into the other to produce a pile foundation. To facilitate inserting driven piles one into each other and thus extending the length of a pile foundation, the driven piles usually have a conically tapering first pile end and a second pile end which is shaped to provide a socket. In that way, the pile foundation can be driven into the ground pile by pile, whereby it is possible to produce pile foundations of any length quickly and inexpensively. Driven piles of that kind are usually produced in a centrifugal casting process with a shaping rotating mold. That results in substantially cylindrical tubular piles which are internally hollow. Depending on the respective kind of use, those tubular or hollow-cylindrical driven piles can be filled or encased with concrete or another suitable injection material to produce a stable foundation after having been driven into the ground.

To produce a so-called shaft-grouted pile foundation, a driven pile is fitted onto a drive point, the outside diameter of the drive point being greater than the outside diameter of the driven pile. In that way, an annular space can be produced during the driving-in operation, and that space can be filled with the injection material or concrete by a pressure grouting operation.

When making pile foundations with known drive points, the worker has to place the drive point on the ground and hold it during the mounting of the pile end of the driven pile into the drive point. As the driven piles to be mounted into the drive point are long and heavy, the holding of the drive point during the mounting is dangerous for the worker.

SUMMARY OF THE INVENTION

The object of the invention is to provide an improved drive point with which pile foundations can be produced, while avoiding the above-described disadvantages.

According to the invention, therefore, it is provided that at least one support device with a ground surface is arranged at an outer surface of the drive point, wherein the ground surface of the at least one support device supports the drive point when placed on a ground into which the drive point is to be driven in a driving-in direction.

In that way, the drive point can be placed on the ground where it stably stands by itself, supported by the at least one support device. Therefore, it is no longer necessary for the worker to hold the drive point during the fitting of the driven pile into the drive end, because the drive point can stand by itself on the ground with the ground surface of the at least one support device. This minimizes the danger for the worker during the fitting of the driven pile into the drive point.

In a preferred embodiment, the ground surface is arranged substantially in parallel to the first support surface. By this, the drive point stands straight and stable on the ground—whereby the driving-in direction is substantially perpendicular to the surface of the ground—and the driven pile can easily and exactly be mounted to the drive point.

In a particularly preferred embodiment, there is provided a plurality of support devices, preferably three support devices. This allows for an optimized stand of the drive point on the ground and an optimized stability during the driving of the driven pile into the ground.

In a preferred embodiment, the at least one support device is in the form of a support rib which projects from the outer surface.

A particularly advantageous embodiment of the invention is that in which three support ribs are arranged evenly distributed in a circumferential direction at the outer surface. In that case, the ground surfaces may extend linearly and may be arranged at angles of 120° to each other.

In a particularly preferred embodiment, the drive point is of a substantially rotationally symmetrical external or outside shape, the axis of rotation extending substantially in the driving-in direction. If an outside diameter of the drive point substantially continuously decreases in the driving-in direction, it is then possible for a pile foundation to be particularly easily driven in, with the use of a proposed drive point. Self-evidently, however, it can also be provided that the outside diameter of the drive point is substantially constant along its extent in the driving-in direction.

A particularly advantageous embodiment of the invention is that in which the outer surface of the drive point is at least sectionwise shaped conically. Preferably, an opening angle of said sectionwise conically shaped outer surface (Y) is between 80° and 100°, preferably about 90°. This allows the drive point to be built more lightweight and with a reduced height.

When producing a shaft-grouted pile foundation, wherein the driven piles are to be covered with injection material or concrete, during the driving operation a pumpable concrete mortar which is usually of a grain size of up to 4 mm is conveyed through the hollow pile core of the driven pile to the foot of the pile and pressed into the ground at the drive point. This means that the concrete pressure grouting operation takes place simultaneously with the pile driving operation and is concluded upon the attainment of the final depth of the pile foundation. The shaft grouting operation permits a considerable increase in the useful load of a pile foundation, in particular in gravels and sands, because a substantially higher level of shaft friction prevails in large-grain grounds between the pressing shaft and the ground, than between the pile tube of an ungrouted driven pile and the ground.

In order that the concrete mortar introduced into the pile core of a driven pile can issue from the driven pile and can form a pressed grouting sheathing around the driven pile, it is known in the state of the art for suitable openings to be cut out of the driven pile. That, however, results in a weakening of the tubular cross section and thus static instabilities of a pile foundation.

In a particularly preferred embodiment, starting from a plane of the first support surface, the drive point has a cavity which extends at least partially in the driving-in direction and into which concrete can be introduced through a pile core of the driven pile when the driven pile is fitted onto the pile end of the driven pile, wherein at least one concrete outlet passage connects the cavity to an upper edge of the drive point.

In that way, during the driving-in operation, concrete mortar or another suitable injection material can be introduced into the annular space between the outside diameter of the drive point and the outside diameter of the driven pile without appropriate openings or incisions having to be made for that purpose in the casing of the driven pile. In other words, when using a proposed drive point, the driven pile does not have to be manipulated at all, whereby there is also no unwanted weakening of the tubular cross section of the driven pile.

In a preferred embodiment, the at least one concrete outlet passage is formed as a recess in the inside wall and/or forms a bulge in the outer surface of the drive point.

In a particularly preferred variant, there can be provided a plurality of concrete outlet passages, preferably three concrete outlet passages. Preferably, in that case, two respective concrete outlet passages of the plurality of concrete outlet passages are arranged in the cross section relative to the driving-in direction along the inside wall of the drive point substantially at equal spacings relative to each other. Self-evidently, the concrete outlet passages can also be so arranged along the inside wall of the drive point that they are at irregular spacings relative to each other.

For centering the driven pile and/or for positionally stable fixing thereof, at least one radially inwardly projecting pile-supporting device can be provided at the inside wall. In that case, preferably the at least one radially inwardly projecting pile-supporting device can be in the form of a pile-supporting rib. The at least one radially inwardly projecting pile-supporting device provides an abutment for an outer shell surface of the driven pile.

In a particularly preferred embodiment, at least one centering device projecting from the first support surface is arranged at the first support surface configured for centering the pile end of the driven pile and/or for positionally stable fixing thereof. This prevents the drive end of the driven pile from slipping from the support surface and blocking the concrete outlet passages but rather the drive end of the driven pile stays stable on the support surface, even if concrete is pumped through the driven pile. The at least one centering device projects from the first support surface in a direction substantially opposite to the driving-in direction and provides an abutment for an inner surface of the driven pile.

In the mounted position, the drive end of the driven pile rests centered on the support surface between the pile-supporting devices and the centering devices.

In a preferred embodiment, the end face of the pile end of the driven pile is located at a circumferential edge of the driven pile and the at least one first support limb is configured to extend from the circumferential edge of the driven pile such that the at least one first support limb is offset from a central axis of the driven pile.

To be able to provide a universally useable drive point for a plurality of driven piles of different outside diameters, it can be provided in a preferred variant that arranged at the inside wall of the drive point is at least one second support limb with a second support surface for an end face of a pile end, wherein the spacing of the second support surface from the edge of the drive point in the driving-in direction is greater than the spacing of the first support surface from the edge of the drive point. It is however also possible for the first and second support surfaces to be in the same plane. Generally, the first and second support surfaces can preferably be in a plane parallel to a cross-sectional plane transversely relative to the driving-in direction.

As generally hollow-cylindrical driven piles are used, an advantageous development of the invention provides that the at least one first support limb and/or the at least one second support limb in the cross section relative to the driving-in direction is/are in the form of a segment of a circle or a segment of a circular ring. It is desirable in that respect if a circular arc of the segment of the circle or circular ring extends over less than 340°, preferably over between 40° and 120°, particularly preferably over between 70° and 90°.

In a preferred embodiment, the drive point at least partially and preferably completely comprises cast iron.

A particularly advantageous embodiment of the invention is that in which the drive point is in one piece. It will be appreciated however that it is also possible for the drive point to be of a multi-part configuration.

In a particularly preferred embodiment, a circumferential collar is arranged along the outer surface of the drive point, said circumferential collar projecting from said outer surface of the drive point. Preferably, the circumferential collar is arranged along the upper edge of the drive point. The circumferential collar provides a cutting effect and reduces or prevents the breaking off of soil around the driven pile during the driving of the driven pile.

An arrangement may comprise a drive point and a cylindrical elongated sleeve, wherein said drive point is arranged inside said cylindrical elongated sleeve, wherein a circumferential support collar projecting radially inwards is arranged on a sleeve end of said cylindrical elongated sleeve and is configured to abut the circumferential collar of said drive point.

In this case, the circumferential collar of the drive point functions as a holder or support for the cylindrical elongated sleeve which provides an additional protection against the breaking off of soil around the driven pile during the driving of the driven pile, in particular when driving the driven point into soft ground.

In a preferred embodiment, the cylindrical elongated sleeve at least partially and preferably completely consists of cast iron or sheet steel. The cylindrical elongated sleeve can also consist of a flexible geotextile with the circumferential support collar consisting of steel.

BRIEF DESCRIPTION OF THE DRAWINGS

Further details and advantages of the present invention are described by means of the specific description hereinafter. In the drawings.

DETAILED DESCRIPTION OF THE INVENTION

Figure 1:
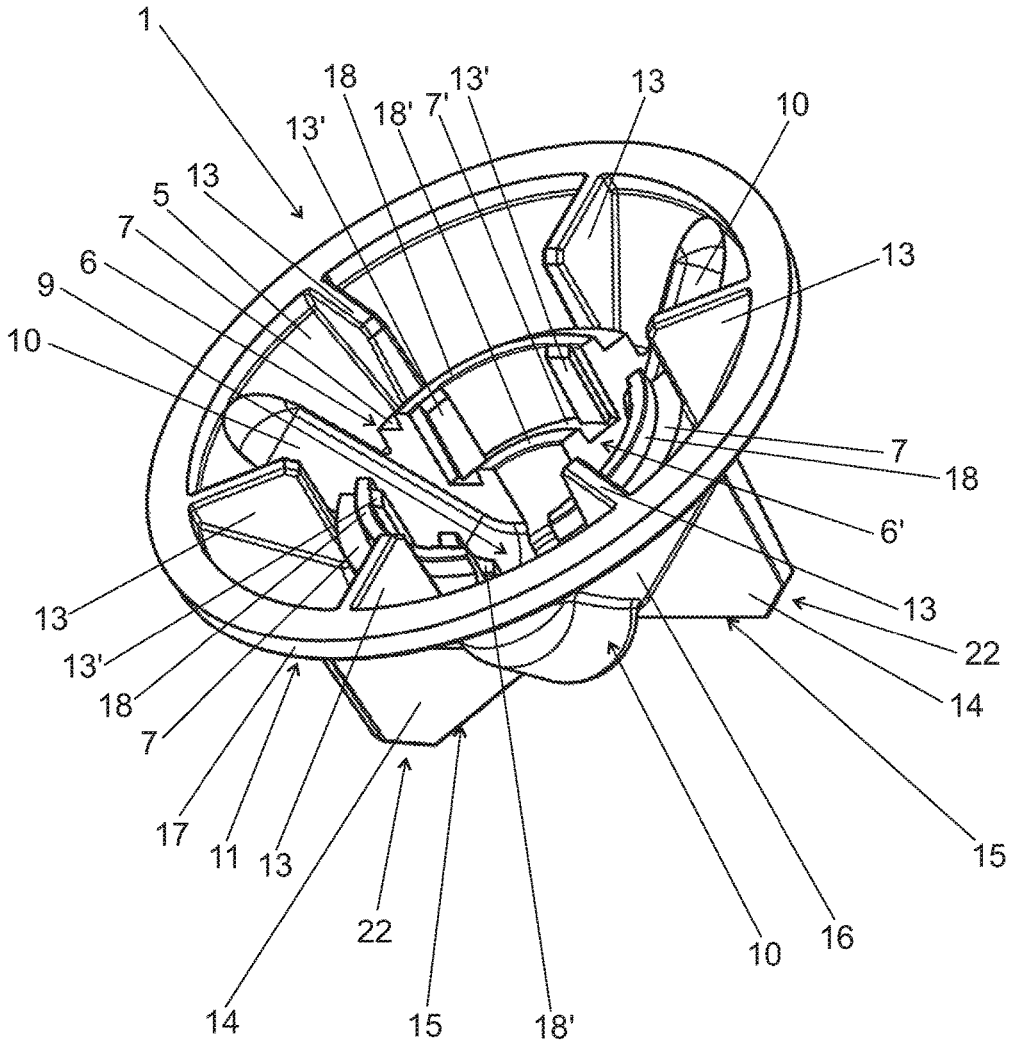
FIG. 1 shows a proposed drive point in a perspective top view.

FIG. 1 shows a proposed drive point 1 in a perspective top view. In this example, the drive point 1 is of a one-part structure and comprises ductile cast iron. The external shape of the drive point 1 is substantially rotationally symmetrical in relation to the axis of rotation R (see FIG. 4*b*). The outer surface 16 of the drive point 1 is at least sectionwise shaped conically, wherein an opening angle of said sectionwise conically shaped outer surface 16 is about 90°.

Figure 5:
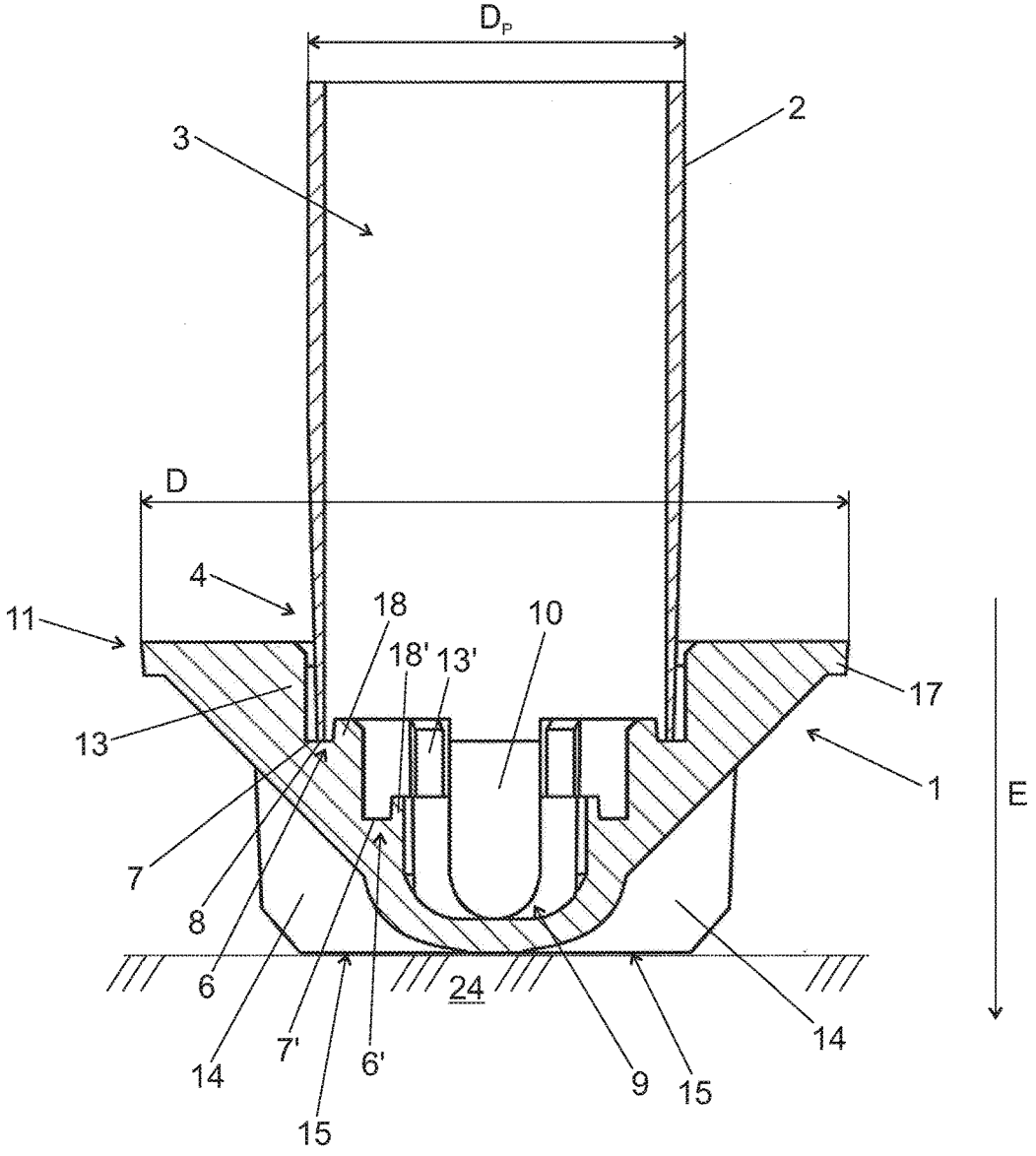
FIG. 5 shows a longitudinal section through a proposed drive point along the driving-in direction with a driven pile fitted thereon.

In this example, three support devices 14 with a ground surface 15 are arranged at the outer surface 16 of the drive point 1, wherein the ground surfaces 15 of the support devices 14 support the drive point 1 when placed on a ground 24 into which the drive point 1 is to be driven in a driving-in direction E (see FIG. 5). The support devices 14 are in the form of support ribs which project radially outwards from the outer surface 16. The support devices 14 have beveled edges 22. As the support devices 14 are in the form of relatively slim ribs and have beveled edges 22, they do not cause much resistance during the driving in of the driven pile 2 into the ground 24. Therefore, the support devices 14 provide the advantage that the drive point 1 can be stably placed on the ground 24 without hindering the driving in of the driven pile 2 into the ground 24.

Starting from the plane of the first support surfaces 7 provided in the drive point 1 is a cavity 9 extending in the driving-in direction E. In this example, three concrete outlet passages 10 are provided between the cavity 9 and the upper edge 11 of the drive point 1. That makes it possible for concrete mortar which is introduced through the pile core 3 of the driven pile 2 and which penetrates into the cavity 9 by way of the end face 8 to pass in production of a pile foundation by way of the concrete outlet passages 10 to the outside wall of the driven pile 2, thus permitting the production of a shaft pressure grouting (see FIG. 5).

In this example, the concrete outlet passages 10 are formed as recesses in the inside wall 5 and they form bulges in the outer surface 16 of the drive point 1.

Projecting from the inside wall 5 of the drive point 1 in opposite relationship to the driving-in direction E are a plurality of first support limbs 6 which each have a first support surface 7. The first support surfaces 7 of the first support limbs 6 are disposed in this case in one plane and in total form a defined abutment for the end face 8 of a pile end 4 of a fitted-on driven pile 2 (see FIG. 5). That defined abutment provides that the driven pile 2 can be fitted on to the drive point 1 in the driving-in direction E to such an extent until the end face 8 of the driven pile 2 bears against the first support surfaces 7 of the first support limbs 6. The maximum depth of insertion engagement of the driven pile 2 in the driving-in direction E is afforded by the spacing T from the upper edge 11 of the drive point 1 to the plane of the first support surfaces 7 (see FIG. 4*b*).

Each concrete outlet passage 10 is arranged between two respective first support limbs 6. In this case, the concrete outlet passages 10 are arranged substantially at equal spacings relative to each other along the inside wall 5 of the drive point 1 in a circumferential direction.

A plurality of pile-supporting devices 13 in the form of pile-supporting ribs are arranged at the inside wall 5 for centering the driven pile 2 and/or for positionally stable fixing thereof.

In this example, centering devices 18 projecting from the first support surface 7 are arranged at the first support surfaces 7 configured for centering the pile end 4 of the driven pile 2 and/or for positionally stable fixing thereof (see FIG. 5).

Besides first support limbs 6 for a first driven pile 2, this embodiment additionally has second support limbs 6' for a second driven pile of a different outside diameter relative to the driven pile 2. Each second support limb 6' has a second support surface 7', wherein the total of the second support surfaces 7' forms a defined abutment for the end face of the second driven pile. In the driving-in direction E, the spacing T' of the second support surfaces 7' from the edge 11 of the drive point 1 is greater than the spacing T of the first support surfaces 7 from the edge 11 of the drive point 1 (see FIG. 4*b*). It will be appreciated that it will also be possible for both support surfaces 7, 7' to be in the same plane. In that case, it would only be necessary for the width of a support surface 7, 7' in the radial direction to be selected to be of such a size that it is suitable for the entire band width of the outside diameters $D_P$ of the driven piles 2 to be employed.

Centering devices 18' projecting from the second support surfaces 7' are arranged at the second support surfaces 7' and are configured for centering the pile end of a driven pile and/or for positionally stable fixing thereof. Further, radially inwardly projecting pile-supporting devices 13' in the form of pile-supporting ribs are arranged at the first support limbs 6 for centering the driven pile and/or for positionally stable fixing thereof.

In this example, a circumferential collar 17 is arranged along the outer surface 16 of the drive point 1, said circumferential collar 17 projecting from said outer surface 16 of the drive point 1 along the upper edge 11 of the drive point 1.

Figure 2:
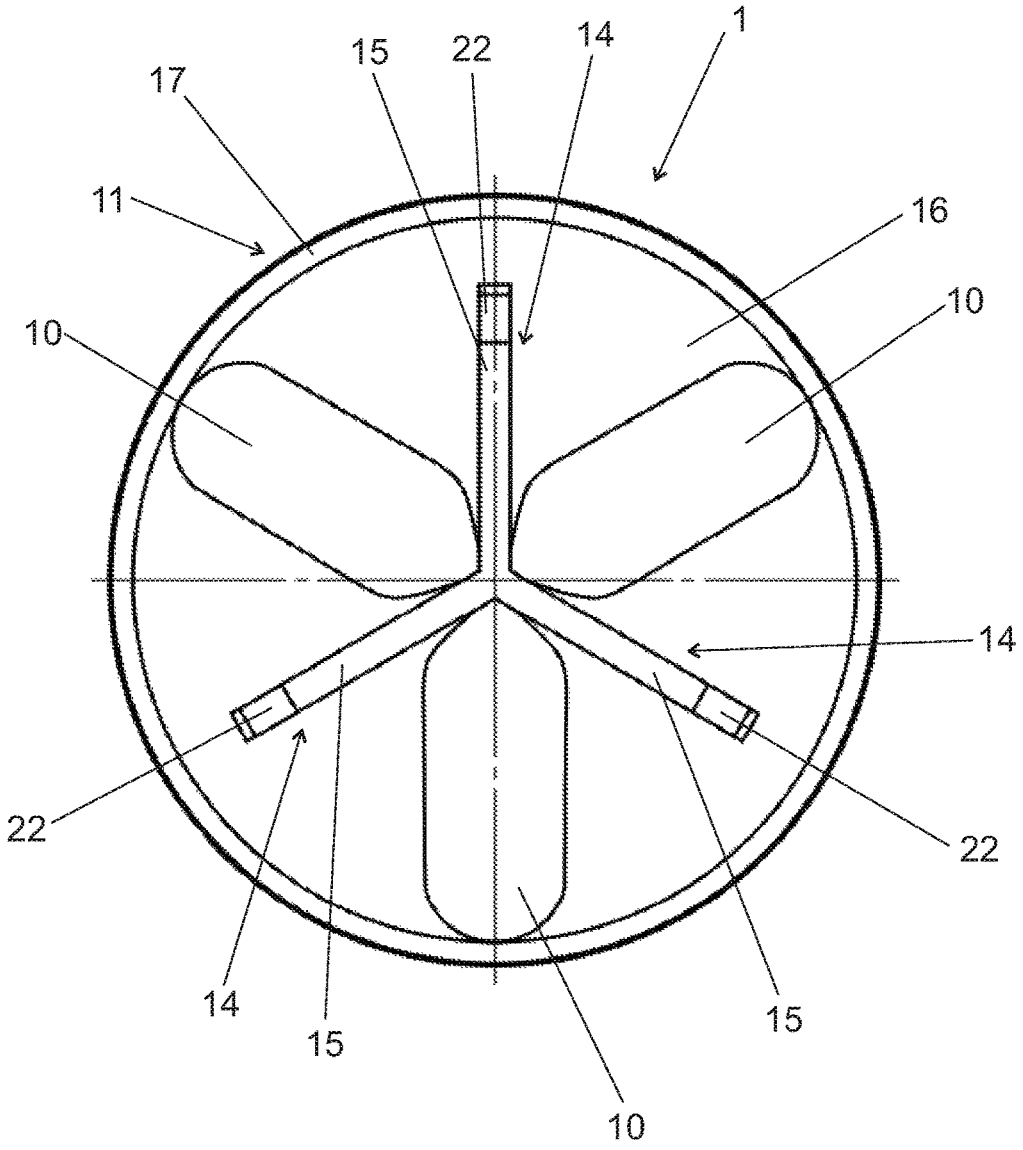
FIG. 2 shows the drive point of FIG. 1 in a bottom view.

FIG. 2 shows the drive point 1 of FIG. 1 in a bottom view. As can be seen, in this example three support devices 14 in the form of support ribs are arranged so as to be evenly distributed in a circumferential direction at the outer surface 16 of the driven pile 1. The ground surfaces 15 of the support devices 14 extend linearly and are arranged at angles of 120° to each other. Three concrete outlet passages 10 form bulges in the outer surface 16 of the drive point 1. The three concrete outlet passages 10 are arranged at angles of 120° to each other, and they are offset from the support devices 14 in a circumferential direction.

Figure 3A:
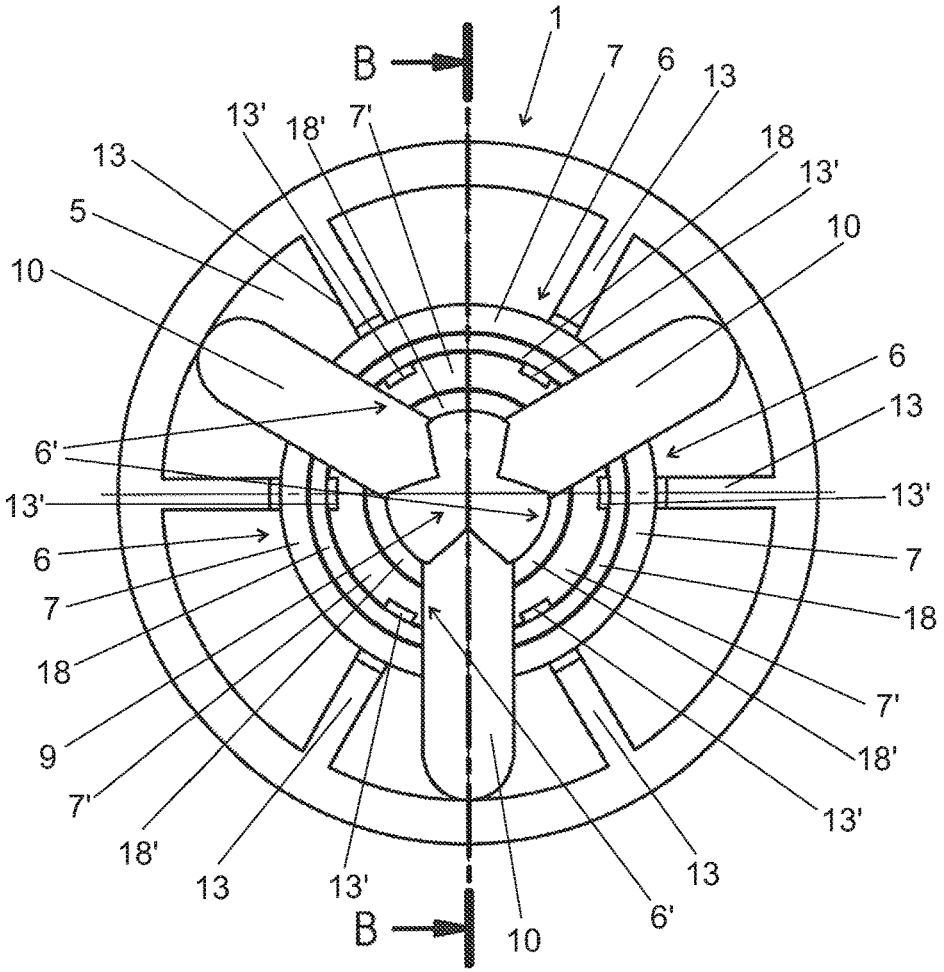
FIG. 3*a* shows the drive point of FIG. 1 in a top view.
Figure 3B:
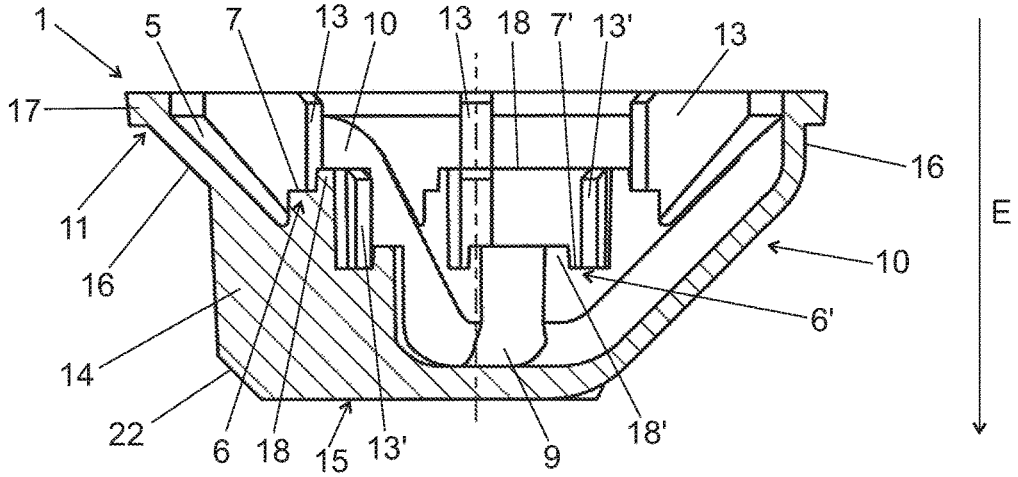
FIG. 3*b* shows a cross section taken along section plane B-B through the drive point of FIG. 3*a*.

FIG. 3*a* shows the drive point 1 of FIG. 1 in a top view, and FIG. 3*b* shows a cross section taken along section plane B-B through the drive point 1 of FIG. 3*a*. The drive point 1 comprises three first support limbs 6, each having a first support surface 7 configured to abut an end face of a pile end of a pile with an outside diameter $D_P$ (see FIG. 5). The drive point 1 further comprises three second support limbs 6', each having a second support surface 7' configured to abut an end face of a pile end of a pile with an outside diameter smaller than $D_P$. The ground surfaces 15 of the support devices 14 define a support plane which is arranged substantially in parallel to the first support surfaces 7 and the second support surfaces 7'.

In this example, each of the three first support limbs 6 and each of the three second support limbs 6' is in the form of a segment of a circular ring in a cross section relative to the driving-in direction E, wherein the segments corresponding to the first support limbs 6 have a larger radius than the segments corresponding to the second support limbs 6'. In this case, the circular arc of each segment of the circular ring extends over a respective angular range of about 90° and the three circular arcs are arranged so as to be distributed uniformly along a notional circle.

Figure 4A:
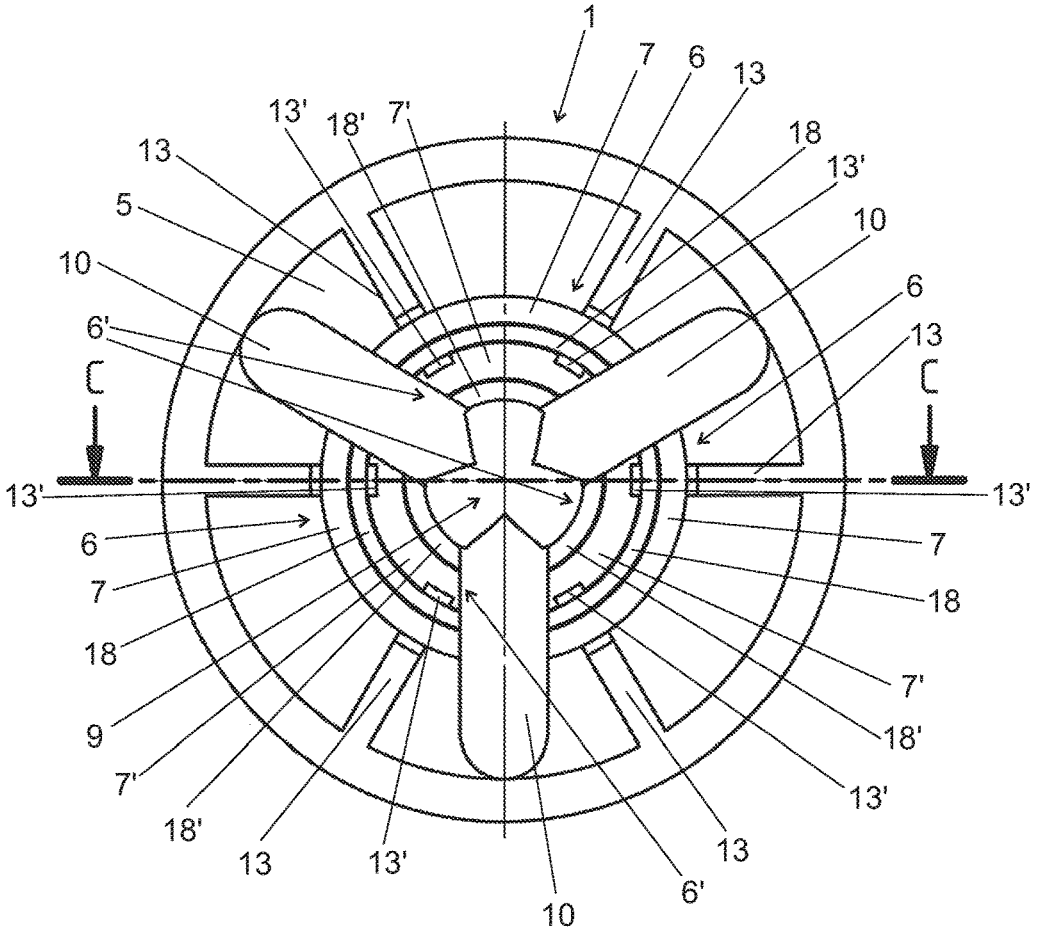
FIG. 4*a* shows the drive point of FIG. 1 in a top view.
Figure 4B:
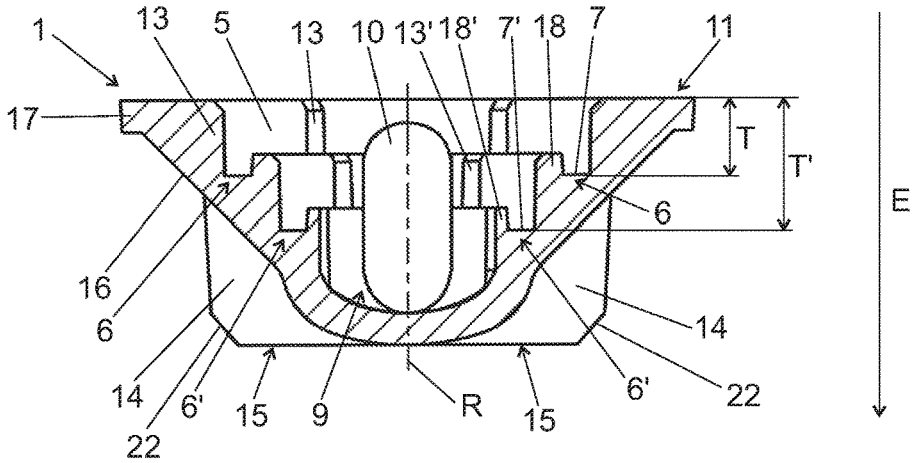
FIG. 4*b* shows a cross section taken along section plane C-C through the drive point of FIG. 4*a*.

FIG. 4*a* shows the drive point 1 of FIG. 1 in a top view, and FIG. 4*b* shows a cross section taken along section plane C-C through the drive point 1 of FIG. 4*a*. The three first support surfaces 7 of the first support limbs 6 are arranged with a spacing T from the edge 11 of the drive point 1 in the driving-in direction E. The three second support surfaces 7' of the second support limbs 6' are arranged with a spacing T' from the edge 11 of the drive point 1 in the driving-in direction E, wherein the spacing T' of the second support surfaces 7' is greater than the spacing T of the first support surfaces 7.

FIG. 5 shows a longitudinal section through a proposed drive point 1 along the driving-in direction E with a driven pile 2 fitted thereon. The drive point 1 stands stably by itself on a ground 24, supported by the ground surfaces 15 of the support devices 14 projecting radially outwards from the outer surface 16 of the drive point 1.

At an upper edge 11, the drive point 1 is of an outside diameter D greater than an outside diameter $D_P$ of a fitted-on driven pile 2. In the driving-in direction E, the outside diameter D of the drive point 1 decreases in a frustoconical configuration in the direction of its end, thereby making it easier to drive in a pile foundation with the fitted drive point 1.

The abutment for the end face 8 of the driven pile 2, which is arranged at the spacing T from the upper edge 11 of the drive point 1 in the driving-in direction E, is formed by a total of three first support surfaces 7 (see FIGS. 4*a* and 4*b*). In the mounted position, the drive end 4 of the driven pile 2 rests centered on the support surfaces 7 between the pile-supporting devices 13 which project radially inwardly from the inside wall 5 and the centering devices 18 which project from the first support surfaces 7 in a direction opposite to the driving-in direction E.

Figure 6:
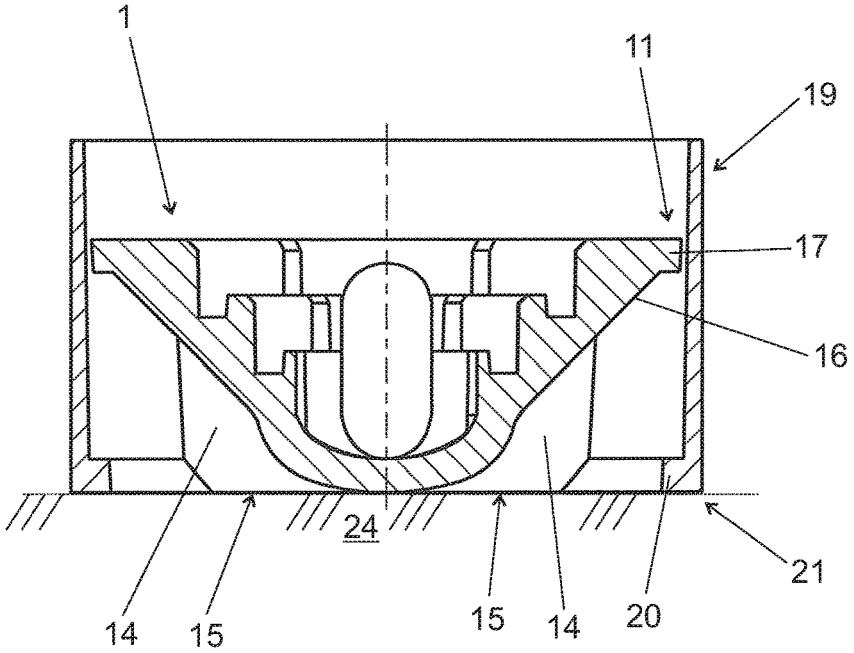
FIG. 6 shows a longitudinal section through an arrangement comprising a proposed drive point and a cylindrical elongated sleeve.
Figure 7:
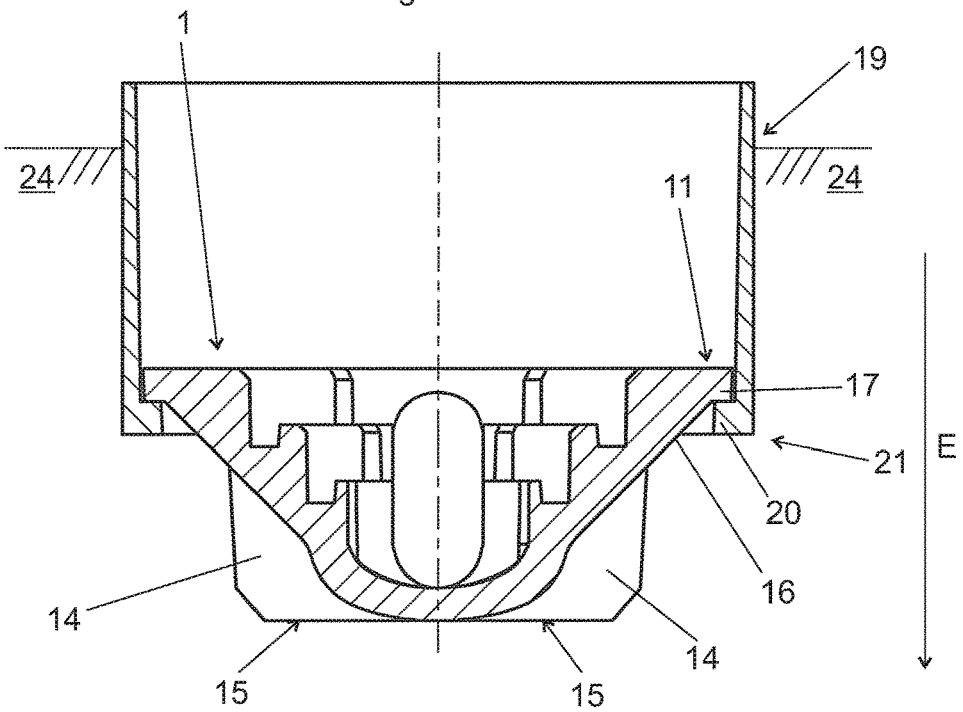
FIG. 7 shows the arrangement of FIG. 6 in a different operating condition.

FIG. 6 shows a longitudinal section through an arrangement comprising a proposed drive point 1 and a cylindrical elongated sleeve 19, and FIG. 7 shows the arrangement of FIG. 6 in a different operating condition. The drive point 1 is arranged inside the cylindrical elongated sleeve 19. A circumferential support collar 20 projecting radially inwards is arranged on a sleeve end 21 of the cylindrical elongated sleeve 19 and is configured to abut the circumferential collar 17 of the drive point 1. FIG. 7 shows the operating condition when the driven pile (not shown) is driven into a ground 24 in the driving-in direction E. As can be seen, the support collar 20 of the cylindrical elongated sleeve 19 abuts the circumferential collar 17 of the drive point 1.

Figure 8A:
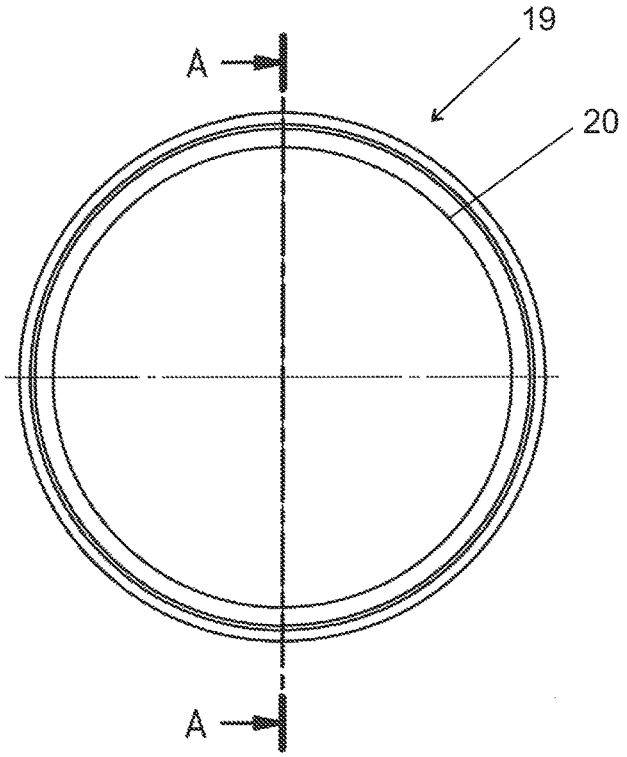
FIG. 8*a* shows a front view of a cylindrical elongated sleeve.
Figure 8B:
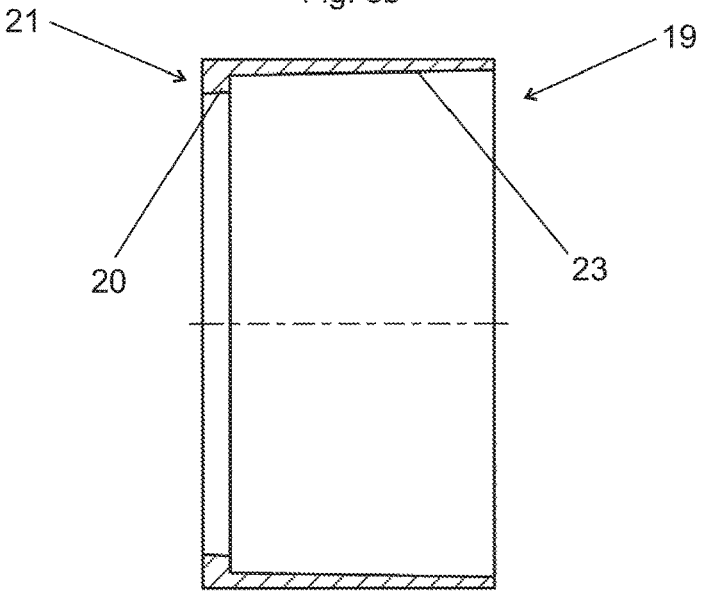
FIG. 8*b* shows a cross section taken along section plane A-A through the cylindrical elongated sleeve of FIG. 8*a*.

FIG. 8*a* shows a front view of a cylindrical elongated sleeve 19, and FIG. 8*b* shows a cross section taken along section plane A-A through the cylindrical elongated sleeve 19 of FIG. 8*a*. In this example, the inner sleeve wall 23 is inclined in the direction towards the sleeve end 21 of the cylindrical elongated sleeve 19.

The invention claimed is:

1. A drive point capable of being fitted onto a pile end of a substantially tubular driven pile, the drive point comprising:

at least one first support limb with a first support surface configured to abut an end face of the pile end of the driven pile, the at least one first support limb being arranged at an inside wall of the drive point, at least one support device with a ground surface, the at least one support device being arranged at an outer surface of the drive point, and the ground surface of the at least one support device supporting the drive point when on a ground into which the drive point is to be driven in a driving-in direction, and a circumferential collar arranged along the outer surface of the drive point, the circumferential collar projecting radially outwards from the outer surface of the drive point, wherein, starting from a plane of the first support surface of the at least one first support limb, the drive point has a cavity which extends at least partially in the driving-in direction and into which concrete is capable of being introduced through a pile core of the driven pile when the drive point is fitted onto the pile end of the driven pile, wherein at least one concrete outlet passage connects the cavity to an upper edge of the drive point, wherein the at least one concrete outlet passage defines a bulge which protrudes outwardly from the outer surface of the drive point, and wherein an entirety of the at least one concrete outlet passage is in line with or below the circumferential collar in the driving-in direction.

2. The drive point as set forth in claim 1, wherein the drive point is of a substantially symmetrical external shape, wherein an axis of rotation extends substantially in the driving-in direction.

3. The drive point as set forth in claim 1, wherein the ground surface of the at least one support device is arranged substantially in parallel to the first support surface of the at least one first support limb.

4. The drive point as set forth in claim 1, wherein the at least one support device comprises a plurality of support devices.

5. The drive point as set forth in claim 4, wherein the plurality of support devices includes three support devices.

6. The drive point as set forth in claim 1, wherein the at least one support device is a support rib which projects from the outer surface of the drive point.

7. The drive point as set forth in claim 6, wherein the support rib is one of three support ribs arranged so as to be evenly distributed in a circumferential direction at the outer surface of the drive point.

8. The drive point as set forth in claim 1, wherein the outer surface of the drive point is at least sectionwise shaped conically.

9. The drive point as set forth in claim 8, wherein an opening angle of the outer surface of the drive point which is at least sectionwise shaped conically is between 80° and 100°.

10. The drive point as set forth in claim 9, wherein the opening angle of the outer surface of the drive point which is at least sectionwise shaped conically is 90°.

11. The drive point as set forth in claim 1, further comprising at least one centering device projecting from the first support surface of the at least one first support limb, the at least one centering device being arranged at the first support surface of the at least one first support limb and being configured for centering the pile end of the driven pile on the drive point and/or for positionally stable fixing of a position of the pile end of the driven pile.

12. The drive point as set forth in claim 1, further comprising at least one radially inwardly projecting pile-supporting device arranged at the inside wall of the drive point, the at least one radially inwardly projecting pile-supporting device being configured for centering the driven pile on the drive point and/or for positionally stable fixing of a position of the driven pile.

13. The drive point as set forth in claim 12, wherein the at least one radially inwardly projecting pile-supporting device comprises a plurality of radially inwardly projecting pile-supporting ribs.

14. The drive point as set forth in claim 1, wherein the at least one concrete outlet passage comprises a plurality of concrete outlet passages.

15. The drive point as set forth in claim 14, wherein the plurality of concrete outlet passages includes three concrete outlet passages.

16. The drive point as set forth in claim 1, wherein the drive point is in one piece.

17. The drive point as set forth in claim 1, wherein the drive point comprises cast iron.

18. The drive point as set forth in claim 17, wherein the drive point consists of cast iron.

19. The drive point as set forth in claim 1, wherein the end face of the pile end of the driven pile is at a circumferential edge of the driven pile and the at least one first support limb is configured to extend from the circumferential edge of the driven pile such that the at least one first support limb is offset from a central axis of the driven pile.

20. The drive point as set forth in claim 1, wherein the driven pile is a first driven pile and the drive point is also capable of being fitted onto a pile end of a second driven pile which is substantially tubular, the drive point further comprising:

at least one second support limb with a second support surface, the at least one second support limb being arranged at the inside wall of the drive point and being configured to abut an end face of the pile end of the second driven pile, wherein a spacing of the second support surface of the at least one second support limb from an edge of the drive point in the driving-in direction is greater than a spacing of the first support surface of the at least one first support limb from the edge of the drive point in the driving-in direction.

21. The drive point as set forth in claim 1, wherein the circumferential collar is arranged along the upper edge of the drive point.

22. An arrangement comprising the drive point according to claim 1 and a cylindrical elongated sleeve, wherein the drive point is arranged inside the cylindrical elongated sleeve, and wherein a circumferential support collar projecting radially inwards is arranged on a sleeve end of the cylindrical elongated sleeve and is configured to abut the circumferential collar of the drive point.

* * * * *